United States Patent [19]

Staats, III

[11] Patent Number: 4,997,208

[45] Date of Patent: Mar. 5, 1991

[54] SECURITY BINDING

[76] Inventor: Henry N. Staats, III, 349 Tenney Cir., Chapel Hill, N.C. 27514

[21] Appl. No.: 456,622

[22] Filed: Dec. 29, 1989

Related U.S. Application Data

[63] Continuation of Ser. No. 256,462, Oct. 12, 1988, abandoned.

[51] Int. Cl.[5] ..... B42D 1/16; B42D 13/12; B42F 3/00

[52] U.S. Cl. ..... 281/28; 281/15.1; 281/21.1; 402/54; 402/80 R; 402/48; 412/6; 412/7; 412/43

[58] Field of Search ..... 281/21.1, 28, 15.1; 402/8, 13, 14, 15, 16, 19, 20, 21, 22, 46, 47, 48, 49, 52, 53, 54, 60, 61, 62, 63, 64, 65, 80 R, 501; 412/43, 6, 7

[56] References Cited

U.S. PATENT DOCUMENTS

| | | | |
|---|---|---|---|
| Re. 28,202 | 10/1974 | Abildgard | 281/21.1 |
| 1,485,431 | 5/1924 | Parker . | |
| 2,201,551 | 5/1940 | Welk . | |
| 3,879,783 | 4/1975 | Giulie | 412/43 |
| 3,970,331 | 7/1976 | Giulie | 281/21.1 |
| 4,175,880 | 11/1979 | Muller | 402/48 |
| 4,309,046 | 1/1982 | Giulie | 402/63 X |
| 4,433,929 | 2/1984 | Jones | 402/80 R |
| 4,620,724 | 11/1986 | Abildgaard et al. | 281/15.1 |
| 4,625,996 | 12/1986 | Hymmen | 402/63 X |
| 4,647,306 | 3/1986 | Chamberlin | 402/48 |
| 4,730,972 | 3/1988 | Sun et al. | 412/43 X |
| 4,743,048 | 5/1988 | Groswith, III | 402/63 X |

FOREIGN PATENT DOCUMENTS

| | | | |
|---|---|---|---|
| 7422 | of 1883 | United Kingdom | 402/80 R |
| 1011255 | 11/1965 | United Kingdom | 402/54 |

*Primary Examiner*—Paul A. Bell

*Attorney, Agent, or Firm*—Hill, Van Santen, Steadman & Simpson

[57] ABSTRACT

A security binder for positively and permanently securing a plurality of sheets of thin material having apertures along one edge, wherein one or more backbone elements are provided with lateral projecting members each having angled projections permitting entry of the members into spaced apertures but preventing removal therefrom; a preferred embodiment incorporates rectangular apertures on a multiple of 0.5625 inch centers with a multiplier of 2 or more and the angled projections extend from the projecting members in a direction longitudinal of the one edge.

30 Claims, 5 Drawing Sheets

FIG. 3A
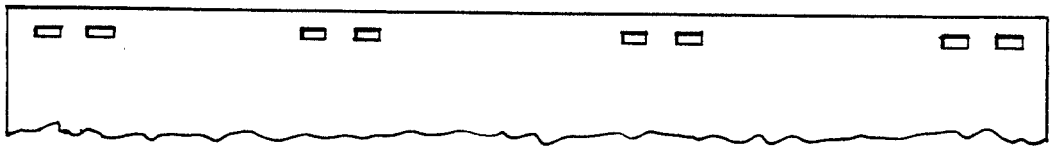
FIG. 3B
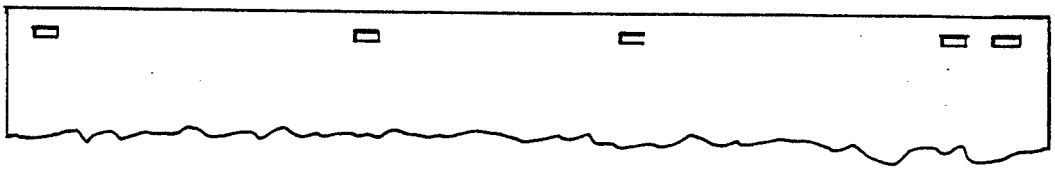
FIG. 4A
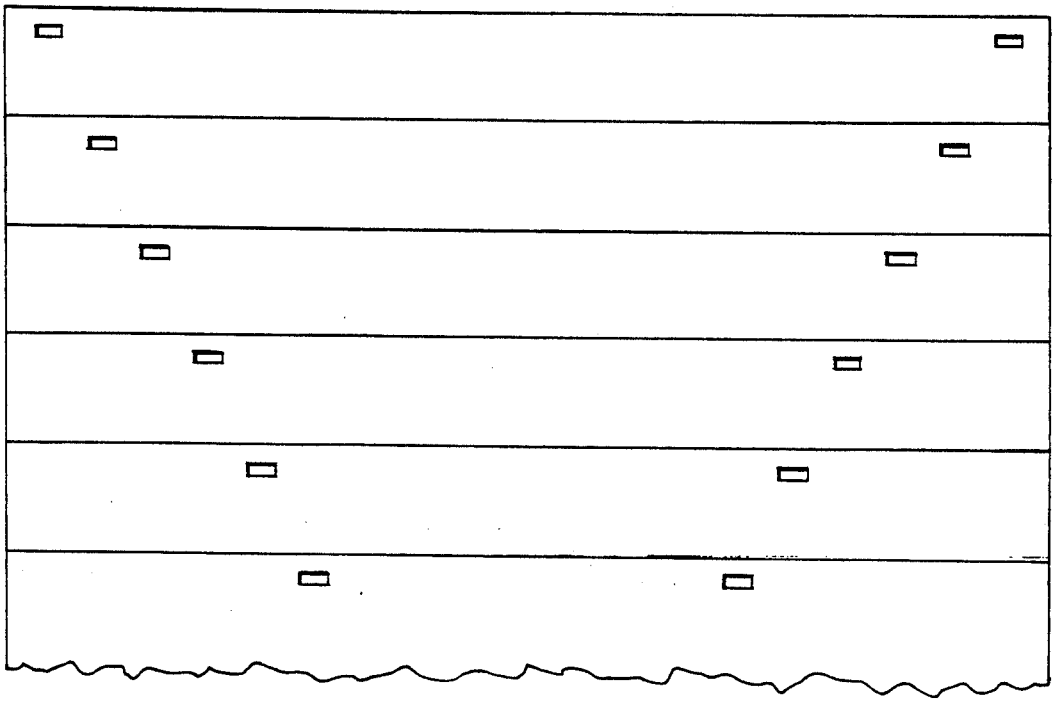
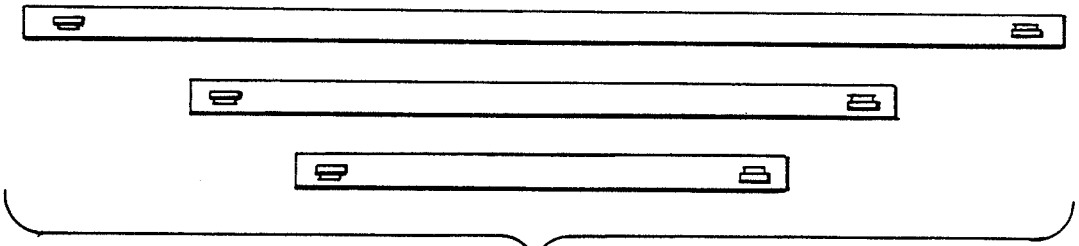
FIG. 4B

FIG. 9
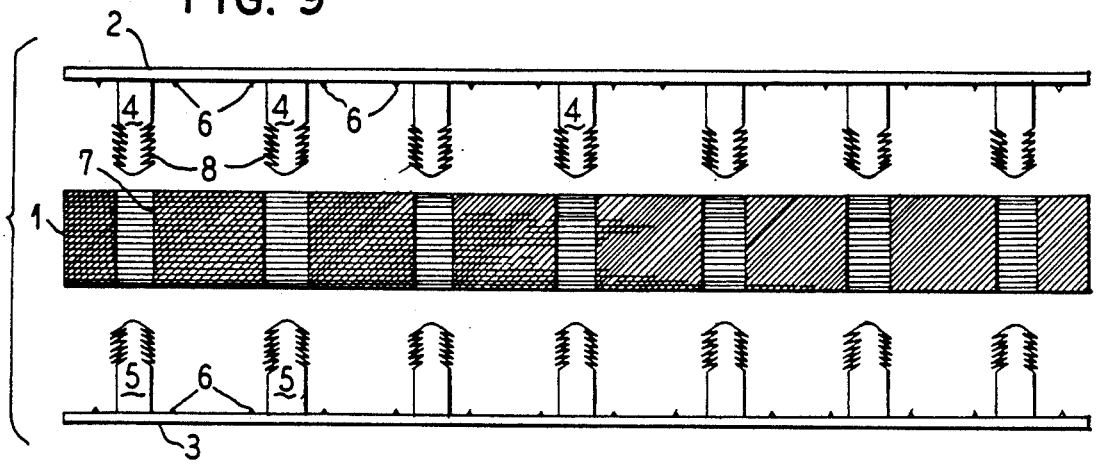
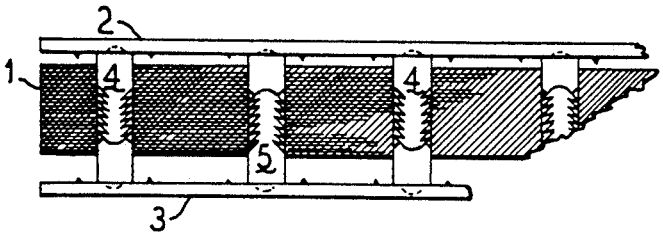
FIG. 10
FIG. 11
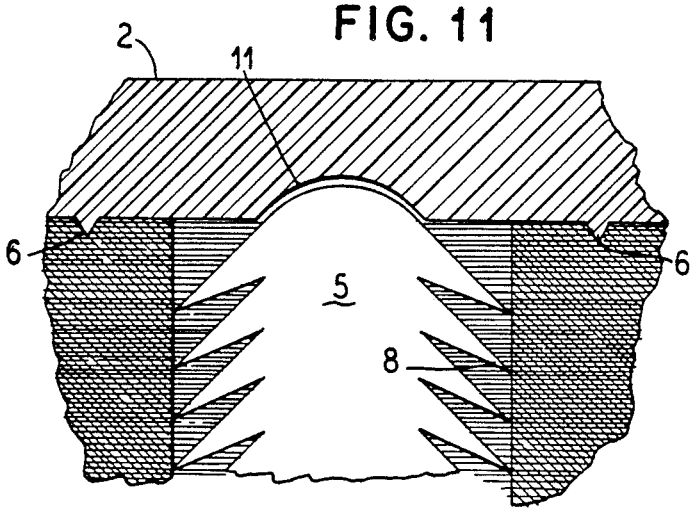

SECURITY BINDING

This application is a continuation of Ser. No. 07/286,462, filed Oct. 12, 1988, and now abandoned.

This invention relates to new and improved molded plastic bindings for use with paper sheets containing holes of a pattern and size identical to those marketed throughout the world by the General Binding Corporation of Northbrook, Ill., for several decades. General Binding Corporation (hereafter GBC) generally employs 19 rectangular holes, each measuring approximately 0.125"×0.300" and located symmetrically on centers of 0.5625" (9/16 inches) near the long binding edge of 8½"×11" sheets of paper as shown in FIG. 1A. The invention described herein is not limited to sheets bearing only 19 rectangular holes and of the dimensions cited. However, domestic markets primarily involve sheets employing 19 holes with overseas markets requiring more than 19 because of larger standard sheet sizes. This disclosure is simplified by discussing only 19 holes or less in combination with 8½"×11" sheets (herein referred to as standard office sheets or paper).

The GBC loose leaf binding system employs flat plastic blanks resembling a comb with the fingers coiled, or curled to underlap the backbone. Users insert the previously coiled binding into a binding machine. Whereupon it is uncoiled slightly so that this stack of paper, bearing hole patterns described earlier, may be engaged with the exposed comb fingers. When the coiled fingers are restored to their original position, the result is a bound stack of sheets which are free to pivot upon the coiled binding. This type of book will lie completely open to a selected page or can be folded back upon itself for more convenient handling. Such bound books can be temporarily unbound to remove, add or change the sequence of sheets.

As the use of GBC plastic bindings proliferated throughout the world, the need arose to bind thicker and heavier books with greater security. This need, then and now could not be met by merely increasing the strength of the plastic binding material itself. This led to GBC's development of its now expired patented binding, marketed as "SURELOX" which employed arrowhead-like tips on two or more fingers that were inserted into appropriately notched holes in the backbone (U.S. Pat. No. 2,910,068). A book bound in this manner would resist physical abuse and still keep the contents secure. In some instances where users required even greater security, adhesives were employed to cement all binding finger tips to the inside of the backbone. Both of these prior security measures left something to be desired with respect to binding speed, convenience and cost. However, both techniques still retained the lie-flat and back-toback features which most users considered important.

In the late 1960's, Velo-Bind, Inc. marketed a binding system which provided for binding sheets securely. Their system described in U.S. Pat. No. 3,596,929 and Reissue 28,202 was designed for use with paper sheets having 0.125" dia. holes and arranged symmetrically in a pattern of 11 holes on 1" centers adjacent the binding edge of standard office paper as described earlier and shown in FIG 1B. Binding is accomplished by inserting a comb-like plastic strip bearing fingers into sheets containing holes coinciding with the fingers. The thickness of the intended bound book must be less than the length of the fingers so that a second, flat strip bearing holes mates with the protruding fingers of the first strip. The assembly is then compressed and the portions of each finger extending beyond the top of the second strip are removed by hot-shearing. The top strip contains counter-bored portions at each hole on its top surface so that the hot-shearing tends to smear near-molten plastic into the depressions, and results in a flush rivet head of sorts.

Generally speaking, the marketplace has accepted VeloBind Bindings despite the fact that its system lacks lie-flatness, back-to-back privileges, and the advantages of "unbinding" a bound book to remove, add or change page sequences without destruction of the original binding. Velo-Bind users encounter occasional catastrophic failure of their rivet heads when thick, bound books are dropped on the floor or opened abruptly after prolonged exposure to cold environments. Despite these negative aspects, thin books bound with the Velo-Bind system have the appearance and reputation of security.

From the foregoing it is clear that there is a need and market for secure as well as non-secure binding systems. I have found it possible to provide a secure sYstem compatible with the GBC binding system in a manner that has never before been envisioned.

In accordance with my invention backbone elements are provided with projections for easy insertion in prepunched sheet apertures. The projections are provided, however, with lateral points preventing removal from the aperture. The binder of the invention cooperates directly with the sheets of paper via the apertures thereof, and also provides a retention force acting longitudinally of the backbone in the direction providing superior binding strength with a reduced number of apertures in each sheet.

A purpose of the subject invention is to provide a means for binding sheets of paper so securely that only deliberate destruction of the binding will free the bound sheets and the evidence of accidental or deliberate tampering will be obvious.

Another purpose of the subject invention is to employ GBC dimensioned holes on any multiple of 0.5625" centers but preferably with fewer holes than 19 on the binding edge of standard sheets of office paper.

DESCRIPTION OF THE DRAWINGS

FIGS. 3A and 3B are plan views of perforated sheets illustrating assymetrical perforation portions related to the system of FIG. 1A;

FIGS. 4A and 4B are illustrations of 2-hole sheets and binder positionings, respectively;

FIG. 9 is a side elevational exploded view of the embodiment of the invention shown in FIGS. 7 and 8 as applied to a stack of sheets;

FIG. 10 is a partial view of the parts of FIG. 9 assembled.

FIG. 11 is a partial side-elevational view of the binding as shown in FIGS. 7, 8 and 9.

DETAILED DESCRIPTION

Figure 1A:
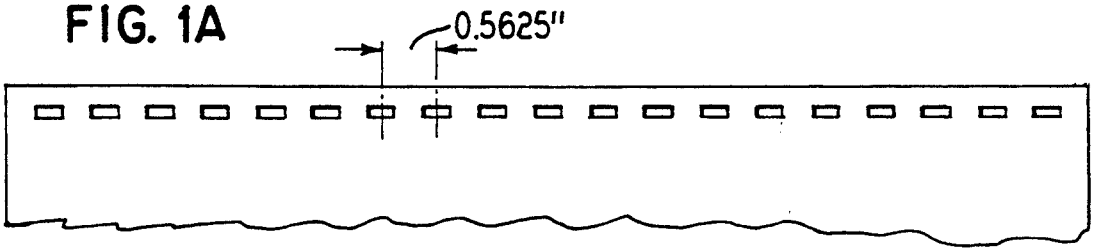
FIG. 1A is a plan view of an edge portion of a perforated sheet of paper according to a prior art system.
Figure 1B:
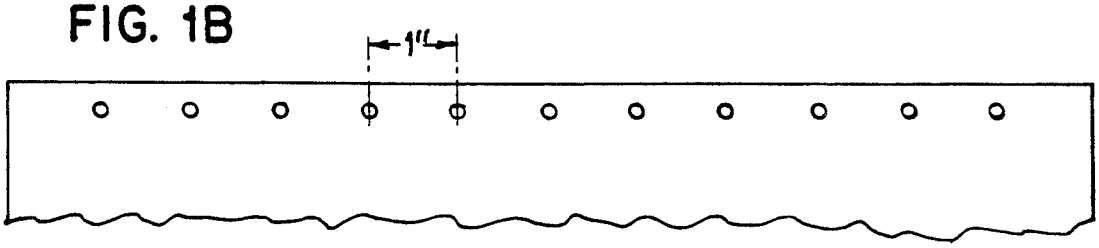
FIG. 1B is a plan view of an edge portion of a perforated sheet of paper according to a further prior art system.
Figure 2A:
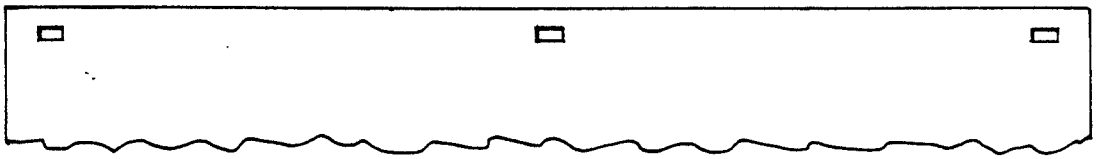
FIGS. 2A, 2B, 2C and 2D are plan views of perforated sheets illustrating symmetrical perforation portions related to the system of FIG. 1A.
Figure 2B:
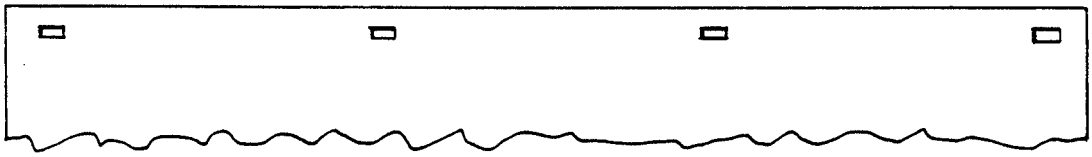

The invention generally employs symmetrical spacing between holes, but with greater spacing than the normal spacing of 0.5625" between holes when the pattern contains the conventional 19 holes. FIGS. 2A. 2B. 2C and 2D illustrate practical patterns possible within the limits of the proposed concept. Additionally, these patterns are the preferred symmetrical and uniformly spaced hole patterns of the invention.

The invention may also employ symmetrical and paired hole spacing typically shown in FIG. 3A or an asymmetrical pattern as in FIG. 3B. While any combination of holes and spaces is possible, symmetrical patterns are preferred because bindings in this configuration may be employed in pairs with no orientation required by the user. FIG. 4A illustrates a plurality of patterns containing only two holes still arranged symmetrically on a multiple of 0.525" centers. The two-hole patterns offer interesting variations where the binding strips are shortened as shown in FIG. 4B.

Since GBC and its competitors have marketed binding systems with 0.5625" hole centers for several decades, it may at first seem unusual that no one has produced a commercial binding for this centering dimension with nonconsecutive fingers for less than 19 holes on the binding edge of standard sheets or their overseas equivalent. This may appear specifically odd since the "punch delete" feature of all punching machines makes it possible to obtain any combination of hole patterns, consecutive or nonconsecutive. There are specific reasons why this situation prevails.

Figure 5:
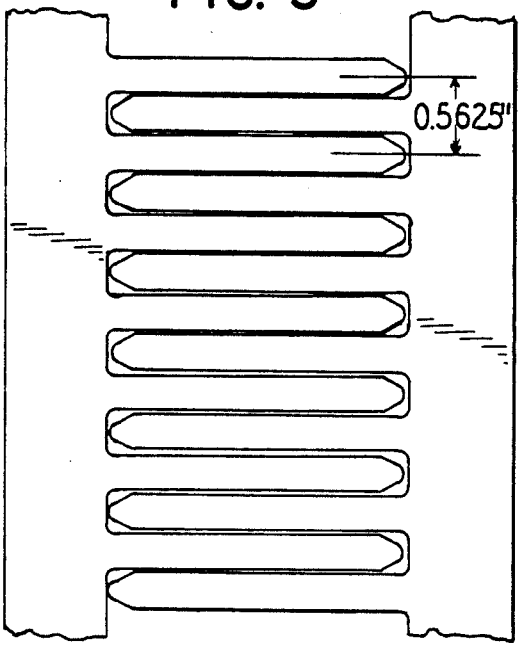
FIG. 5 is a plan view of binder parts in process of stamping in accordance with the prior art.
Figure 6:
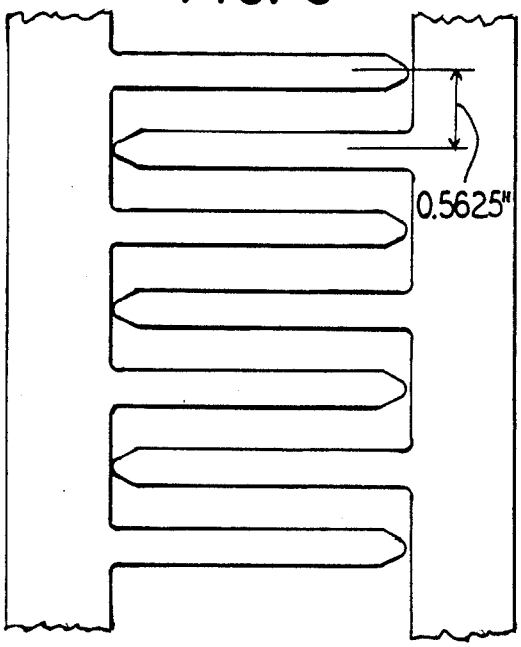
FIG. 6 is a variation of the plan view of FIG. 5.

In the late 1950's it was generally known that GBC semi-automated their production of plastic binding cobs by punching endless paired strips simultaneously with the fingers of both strips on 0.5625" centers as shown in FIG. 5. The length of any binding, containing the desired number of consecutive fingers could be automatically controlled by cutting and separating the flat combs from their parent strips and stacking them for further processing. This procedure yielded precision piece parts with less than 10% scrap while allowing the most economic utilization of expensive plastic binding material. While the process yielded flat combs of any length, the preponderance of bindings sold consisted of 19 fingers per the 11" side of domestic office paper. The GBC punching process used in the manufacture of flat comb blanks with fewer fingers is unsatisfactory then and now for producing blanks with fewer fingers and more spaces for use on an 11" binding edge, as clearly illustrated in FIG. 6. If the punching process were used for producing fewer fingers, say 10 instead of 19 per 11" binding edge, the scrap rate would increase from 10% to 40%. Scrap polyvinyl chloride, a commonly used plastic binding material is not generally worth reprocessing so that the higher scrap loss, then and now, would be economically intolerable. Even if a 40% loss were tolerable, the ability of a 10 fingered binding per 11" binding edge to hold its rated capacity would be diminished by half. Accordingly, no one, to the knowledge of the instant inventor, ever seriously considered using fewer fingers on 0.5625" centers than 19 on the 11" binding edge of standard office paper. However, plastic binding lengths of any length with fingers on 0.5625" centers can be obtained from 1 to any practical number on widely available GBC equipment.

All of GBC's manual and electric punching machines are capable of punching as many as 21 or 28 rectangular holes on 0.5625" centers in paper sheets. All GBC punching machines and most competitive ones contain "punch delete" privileges for any hole-punching position. Punch positions deleted from a 21 punch machine to obtain a 19-hole array could include both end positions 1 and 21 or punches 1 and 2 on the same end.

As above noted, this invention consists of new and novel plastic binding intended to lock stacks of preferably rectangularly perforated paper sheets together securely on a multiple of 0.5625" centers but preferably with fewer holes than 19 on the long side of 8½"×11" sheets. Further, it is intended that this binding, once loaded and closed shall remain closed securely for whatever life was intended by the user. It also is intended that the binding must be destroyed or show evidence of tampering in order to add, remove, or change the sequence of bound sheets. The binding disclosed herein is compatible with most GBC bindings, punching machines, binding systems and associated products based on hole centers of 0.5625". This includes competitive equipment and supplies making use of the same hole centers. While the concepts described herein provide a particularly effective combination system, they need not to be restricted to the dimensional centers, hole sizes, number of holes and punch patterns specifically described in this disclosure.

Figure 7:
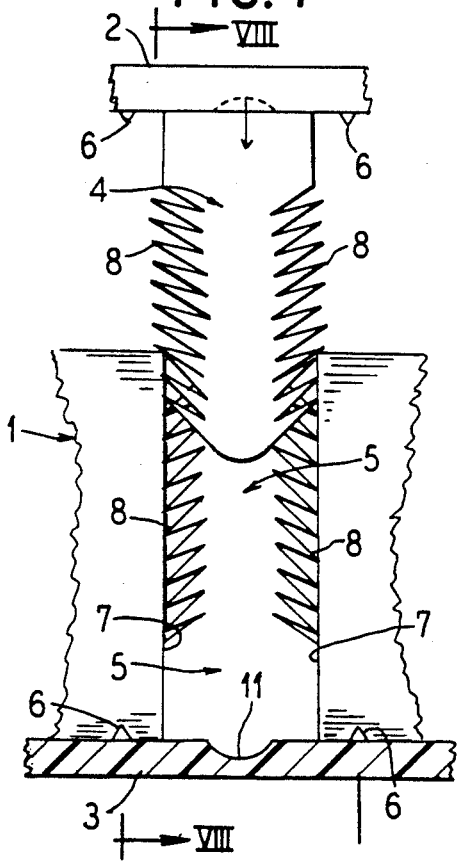
FIG. 7 is a partial side elevation of a first embodiment of the secure binding system of my invention.
Figure 8:
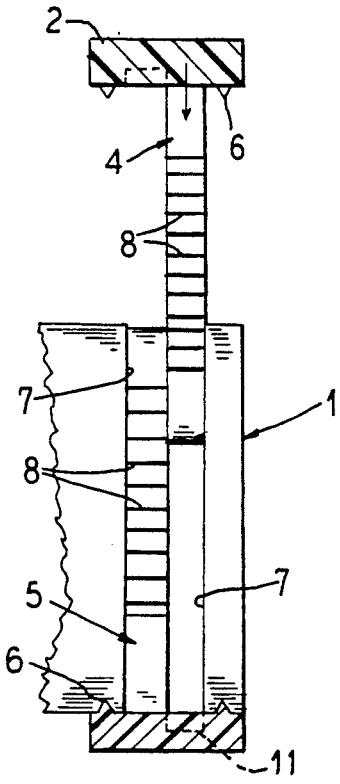
FIG. 8 is a partial cross-sectional view taken along lines VIII—VIII of FIG. 7.
Figure 13:
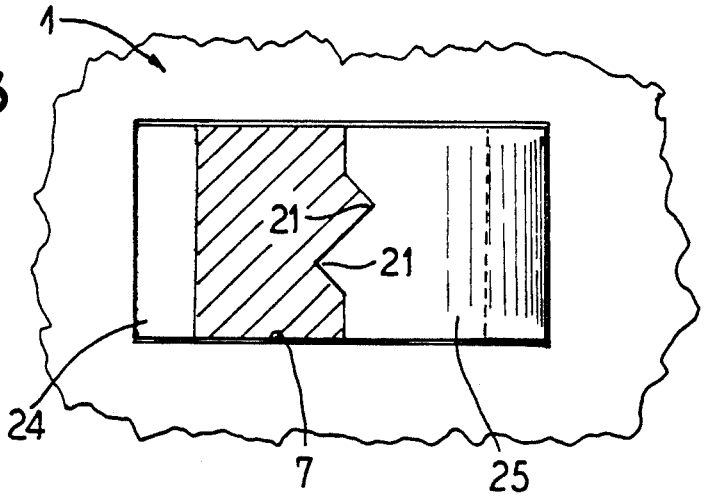
FIG. 13 is a cross-sectional view of FIG. 12 taken along line XIII—XIII.

FIGS. 7 and 8 illustrate an embodiment of the invention where punched paper sheets 1, instead of being loose and rotatable as in looseleaf notebooks or conventional plastic bindings, are clamped tightly between strips 2 and 3. Each strip bears a number of projections 4 and 5, each having sharp raised points 6, the latter to reduce sheet movement during and after binding. Projections 4 and 5 pass each other as they are inserted into hole 7 in paper sheets 1. Both projections 4 and 5 incorporate a multiplicity of sharp pointed barbs 8 which extend outwardly from opposite sides of each projection. As each projection is pushed into its side of hole 7, the barbs 8 project outwardly so that they interfere with entry into the hole to the extent that they bend as shown in FIG. 7. As the barbs 8 bend, their sharp tips engage the sidewalls of the punched hole 7 in the individual sheets so that it is nearly impossible to remove the projections without self-destruction or distortion of the binding strips and the paper sheets involved in the original binding operation. FIG. 9 illustrates top strip 2 and bottom strip 3 with their projections 4 and 5, and barbs 8 poised to penetrate paper sheets 1.

FIG. 10 illustrates strips 2 and 3 partially engaged within the stacked sheets. As there shown, the projections 4, 5, may alternate in their transverse positions upon their respective strips to guarantee that all sheets will be aligned with each other throughout the stack upon completion of binding, and still permit a single molded part 2 (for example) to be used for both parts 2 and 3. FIG. 11 illustrates the use of molded "pockets" 11 on the inner surfaces of strips 2 and 3 to receive the tips of projections 4 and 5. This feature enhances the thickness range of paper stacks so that no more binding sizes than four will be required to handle most market needs as illustrated below:

| BINDING NUMBER | APPROXIMATE NUMBER OF SHEETS | APPROXIMATE BOOK THICKNESS (INCHES) |
|---|---|---|
| 1 | 10 to 45 | 1/32 to 3/16 |
| 2 | 45 to 90 | 3/16 to 3/8 |
| 3 | 90 to 205 | 3/8 to 13/16 |
| 4 | 205 to 400 | 13/16 to 1 5/8 |

While prior art patents such as Parker U.S. Pat. Nos. 1,495,431, Welk 2,201,551 and Muller 4,175,880 have provided tubular and/or ratcheting elements passing through a stack of bound sheets, they have not provided direct contact of flexible ratcheting projections with the sheet aperture's edges. This provides a superior binding relationship with outstanding security against disassembly and particularly against clandestine disassembly that would not be noticed. Separation of documents bound according to this invention noticeably injures the paper sheets.

Figure 2C:
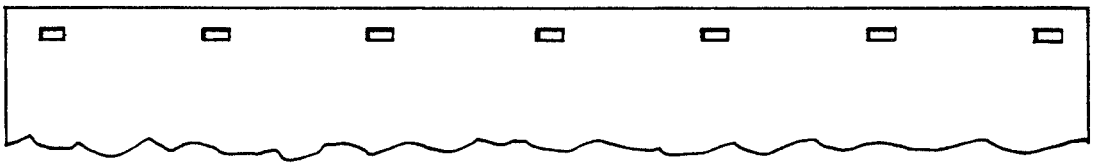
Figure 2D:
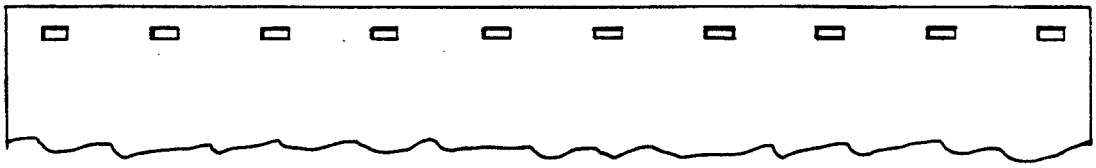

My invention need not be limited to rectangular hole patterns on only 0.5625" hole centers and applicable only to GBC binding systems. My invention can be employed wherever a multiplicity of holes on any centers appear near the binding edge of any sized sheet of paper or plastic. Likewise, the shape of holes in the sheets need not be limited to rectangles since round oval decorative and square-holed systems will function as the holes illustrated in this disclosure. Where different shaped holes are employed, however, it is pre±erred that the cross section of the projections to be changed to match such shape. As noted above, my binding elements provide an especially effective combination with the GBC aperture and center spacing . I find that use of 7 holes of the pattern (FIG. 2C) is preferred. Punching 7 holes in a paper punch requires less than half the effort required for punching 19 holes. Accordingly, more than twice as many sheets may be punched at once. My system provides, in this embodiment, a stronger, more economical system to make and use, and is not impacted by traditional scrap considerations. Also, the intentionally high stress caused by the projections 8 against the edge of the aperture in the direction longitudinally of the perforated edge of the sheets, in assembly, and after assembly, makes an increased longitudinal spacing structurally preferred.

I prefer to employ 7 or 10 apertures per standard sheet as providing superior sheet strength and resistance to tearing between apertures. At the same time the substance of the binding elements provides a binding element that is very strong and suitable for heavy duty, industrial, bindings.

Figure 12:
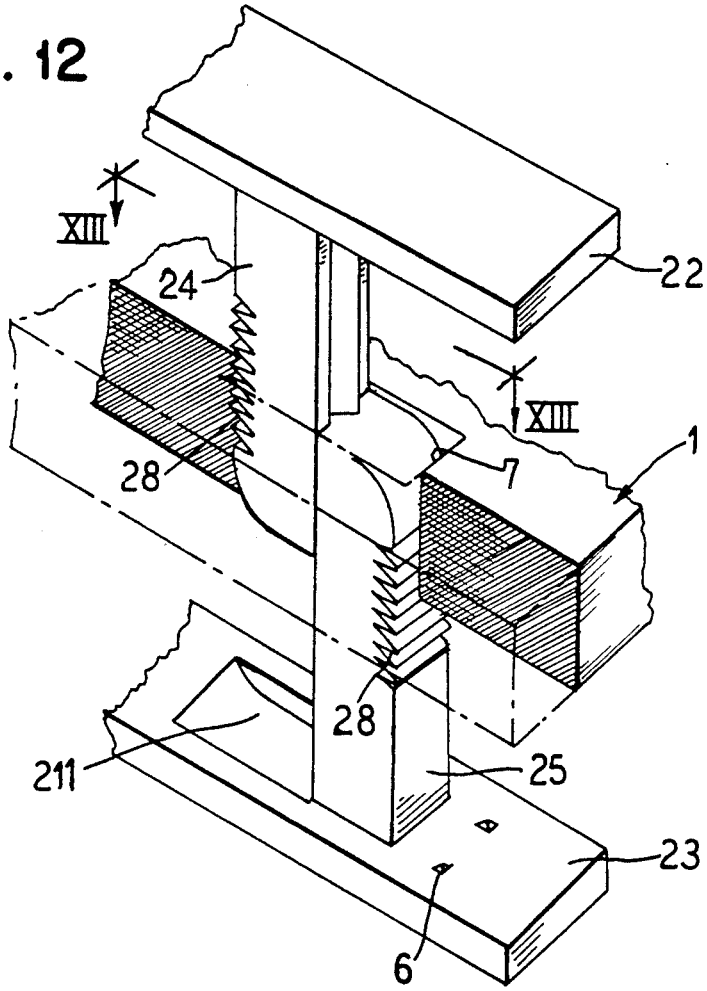
FIG. 12 is a view of another embodiment of the invention.

In a further embodiment, the projections 4, 5 may be placed edge to edge rather than overlapping. Such an embodiment is shown in FIG. 12 where strips 22, 23 may preferably be the same. There projections 24, 25 still press against the longitudinal ends of the apertures 7 and pockets 211 permit the projections 24, 25 to interengage with the strips 22, 23 strengthening the final assembly. Likewise, guide rails 21 cooperate to lock the projection together, and still permit the members 22, 23 to be identical.

In practice, the molded backbone - projection elements may be made of any suitable plastic material that is substantially rigid but which allows the elements 8 to be flexible to permit insertion into the sheet apertures, but do not readily permit deflection allowing the projections to pull out of the apertures.

It will be seen that the specific shape of the angled projections 8 may be varied. They may, as shown, be generally rectilinear and extend across the full width of the projection 4, 5. However, since the binding is preferably molded, the projections could, for example, comprise slanted, conical projections with the tips contacting the aperture edges. Similarly, the projection 8 could be serrated and/or roughened to modify the contacting surfaces. Further, since the forces applied against the sheets are longitudinal of the sheet edge, the projections 4, 5 can be provided with extensions 8 on only one edge, cooperating with oppositely directed one-edge extensions 8 on a spaced projection 4, 5, thereby acting to stretch the paper between the opposed, spaced, projections.

I claim as my invention:

1. A security bound book comprising a substantially permanently assembled plurality of sheets of material having spaced apertures along and adjacent to one edge thereof including:

at least one backbone element having a plurality of perpendicularly projecting members spaced to enter a plurality of said spaced apertures, each projecting member having a plurality of angled projections thereon flexibly contacting at least two oppositely facing aperture sides of at least one sheet aperture preventing retrograde movement of the projecting members out of the cooperating apertures.

2. The structure of claim 1 wherein each projecting member has projections on at least two opposing sides thereof.

3. The structure of claim 2 wherein the openings in each of said sheets, and each cooperating said projecting member are substantially curved.

4. The structure of claim 1 wherein the binding comprises two backbone elements, both having projecting elements inserted into apertures in the stack of sheets from the opposite sides.

5. The structure of claim 4 wherein each backbone includes a pocket into which the end of the mating projecting member of the other backbone seats.

6. The structure of claim 4 wherein the projecting members of both backbones share the same apertures.

7. The structure of claim 6 wherein the projections lie in the apertures with the dimension of each projection being substantially the same as the longitudinal dimension of its respective apertures.

8. The structure of claim 7 wherein the total lateral dimension of the projections lying in an aperture are in total substantially the same as the lateral dimension of the respective aperture.

9. The structure of claim 6 wherein the projecting members are thin, flat rectangular elements having projections on their edges to engage the edges of the apertures in said sheets.

10. The structure of claim 1 wherein the projecting member has a cross-section only slightly smaller, exclusive of the angled projections, than the aperture cooperating therewith.

11. The structure of claim 1 wherein the apertures are spaced on multiples of 0.5625" centers and the multiplier is at least 2.

12. The structure of claim 1 wherein the apertures are spaced on multiplier of 0.5625" centers and the projections are constructed on a spacing of multiplier of 0.5625" centers wherein the multiplier is at least 2.

13. In a security bound book comprising a permanent assembly of a plurality of sheets of material having spaced apertures along and adjacent to one edge thereof bound by at least one backbone element, said book including at least one backbone element having a plurality of perpendicularly projecting members spaced to enter a plurality of said spaced apertures, each of said projecting members having a plurality of angled projections thereon to flexibly contact said material at at least one side of a respective aperture when the projecting member is inserted therein to prevent retrograde movement of such projecting member out of said respective aperture.

14. The improved structure of claim 13 wherein projecting members of two backbone elements enter said apertures from opposite directions.

15. The improved structure of claim 14 wherein said angled projections of at least one of said projecting members project to flexibly contact said material at opposing sides of at least one of said apertures.

16. A bound book comprising a permanent assembly of a plurality of sheets of material having spaced apertures along and adjacent to one edge thereof bound by a pair of opposed backbone elements, said opposed backbone elements both having a plurality of perpendicularly projecting members spaced to enter a plurality of said spaced apertures from opposite directions, each projecting member having a plurality of angled projections thereon flexibly contacting at least one aperture side of at least one sheet aperture preventing retrograde movement of the projecting members out of the cooperating apertures.

17. The structure of claim 16 wherein each projecting member has angled projections on at least two oppositely facing sides thereof.

18. Security binding structure for permanently assembling a plurality of sheets of material having apertures along and adjacent one edge thereof spaced a predetermined distance from each other and each aperture having a predetermined size and shape, said binding structure comprising at least one backbone element having a plurality of projecting members projecting from one face thereof and spaced in a multiple of said predetermined distance, each projecting member having a plurality of flexible angled projections thereon facing at least one side of the projecting member, with the maximum dimension across the projecting member including the flexible projections being larger than said side with said angled projections unflexed and substantially the same as or smaller than said side with said projections flexed.

19. Security binding structure set forth in claim 18, wherein each projecting member has angled projections on at least two opposite sides thereof.

20. Security binding structure set forth in claim 18, wherein the binding comprises two backbone elements, each having projecting members positioned for side-by-side cooperation with projecting members of the other.

21. Security binding structure set forth in claim 18, wherein cooperating projecting members of both backbones are positioned to share the same aperture.

22. Security binding structure set forth in claim 18, wherein the projecting members are each thin, flat rectangular elements having angled projections on their edges facing the length of the backbone element.

23. Security binding structure set forth in claim 18, wherein each backbone has a recess adjacent the base of each projecting member into which the end of the respective cooperating projecting member of the other backbone extends.

24. Security binding structure set forth in claim 18, wherein the projecting members are spaced on multiples of 0.5625" centers and the multiplier is at least 2.

25. Security binding structure set forth in claim 18 wherein said angled projections of said projecting members flexibly project therefrom in opposite directions.

26. Security binding structure set forth in claim 18 wherein said binding structure comprises two opposed backbone elements both having a plurality of perpendicularly projecting members spaced a multiple of said predetermined distance and facing in opposite directions, each projecting member having a plurality of angled projections thereon for flexibly contacting at least one side of at least one sheet aperture preventing retrograde movement of each projecting member out of a cooperating aperture.

27. The security binding structure of claim 26 wherein the perpendicularly projecting members of one backbone element cooperate with perpendicularly projecting members of the other opposed backbone element.

28. Security binding structure for permanently assembling a plurality of sheets of material having apertures along and adjacent one edge thereof spaced a predetermined distance from each other and each aperture having a predetermined size and shape, said binding structure comprising two backbone elements having a plurality of projecting members spaced in a multiple of said predetermined distance for opposing cooperation, each projecting member having a plurality of flexible angled projections thereon extending from at least one side of the projecting member with the dimension across opposing cooperating projecting members being larger than said size when said angled projections are unflexed and the same or smaller than said size when said projections are flexed.

29. The structure of claim 28 wherein each projecting member has flexible angled projections extending from both sides thereof.

30. The structures of claim 28 wherein the projecting members cooperate edge to edge, with each projecting member having angled projections on its edge opposite to its edge in edge to edge cooperation.

* * * * *